US008571452B2

(12) United States Patent
Seto et al.

(10) Patent No.: US 8,571,452 B2
(45) Date of Patent: Oct. 29, 2013

(54) TRANSFER AND FIXING DEVICE USING RADIANT HEATING AND IMAGE FORMING APPARATUS USING SAME

(75) Inventors: Takashi Seto, Yokohama (JP); Takashi Fujita, Yokohama (JP); Atsushi Nagata, Atsugi (JP); Hiromitsu Takagaki, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 574 days.

(21) Appl. No.: 12/458,316

(22) Filed: Jul. 8, 2009

(65) Prior Publication Data

US 2010/0014897 A1 Jan. 21, 2010

(30) Foreign Application Priority Data

Jul. 9, 2008 (JP) ..... 2008-179239

(51) Int. Cl.
*G03G 15/16* (2006.01)
*G03G 15/00* (2006.01)

(52) U.S. Cl.
USPC ..... 399/307; 399/45

(58) Field of Classification Search
USPC ..... 399/296, 307, 320, 335, 336, 338, 45, 399/67
See application file for complete search history.

(56) References Cited

U.S. PATENT DOCUMENTS 4,430,412 A * 2/1984 Miwa et al.
4,435,069 A * 3/1984 Sato ..... 399/336
4,455,079 A * 6/1984 Miwa et al.
4,518,976 A * 5/1985 Tarumi et al.
7,031,648 B2 4/2006 Takashi et al.
7,058,330 B2 6/2006 Nakafuji et al.
7,127,202 B2 10/2006 Fujita et al.
7,139,520 B2 11/2006 Echigo et al.

(Continued)

FOREIGN PATENT DOCUMENTS

JP 60093466 A * 5/1985
JP 60242486 A * 12/1985

(Continued)

OTHER PUBLICATIONS

JP 10-063121; Mar. 6, 1998; Publication Abstract of Japanese Patent 3042414.

(Continued)

*Primary Examiner* — Walter L Lindsay, Jr.
*Assistant Examiner* — Milton Gonzalez
(74) *Attorney, Agent, or Firm* — Harness, Dickey & Pierce, P.L.C.

(57) ABSTRACT

A transfer and fixing device as means for heating a recording medium prior to transfer and fixing, without risk of fire, superior in energy efficiency, and able to stably heat irrespective of the thickness of the recording medium; and an imaging forming apparatus comprising such a transfer and fixing device comprising: a transfer and fixing member by which an image is transferred; a pressurizing member that forms a nip by pressure contact with the transfer and fixing member and pressurizes and fixes the image on the recording medium that passes through the aforementioned nip; a radiant heat source that is arranged on the upstream side of the nip in the direction of transport of the recording medium; and a thermoconductive member that is heated by the radiant heat source and heats the recording medium when in contact, wherein a radiant heat region is provided, between the nip and the thermoconductive member, where the recording medium is heated by radiant heat from the radiant heat source.

20 Claims, 8 Drawing Sheets

(56) References Cited

U.S. PATENT DOCUMENTS

| | | | |
|---|---|---|---|
| 7,177,580 | B2 | 2/2007 | Nakafuji et al. |
| 7,233,762 | B2 | 6/2007 | Kunii et al. |
| 7,254,362 | B2 | 8/2007 | Kikuchi et al. |
| 7,269,384 | B2 | 9/2007 | Someya et al. |
| 7,299,003 | B2 | 11/2007 | Kurotaka et al. |
| 7,333,760 | B2 | 2/2008 | Baba et al. |
| 7,359,666 | B2 | 4/2008 | Takashi et al. |
| 7,369,803 | B2 | 5/2008 | Echigo et al. |
| 7,433,641 | B2 | 10/2008 | Kikuchi et al. |
| 2004/0037595 | A1 | 2/2004 | Takashi et al. |
| 2005/0025534 | A1 | 2/2005 | Fujita et al. |
| 2005/0025537 | A1 | 2/2005 | Echigo et al. |
| 2005/0111871 | A1 | 5/2005 | Nakafuji et al. |
| 2005/0117943 | A1 | 6/2005 | Nakafuji et al. |
| 2005/0152721 | A1 | 7/2005 | Kikuchi et al. |
| 2005/0163529 | A1* | 7/2005 | Teshigawara |
| 2005/0201783 | A1 | 9/2005 | Kurotaka et al. |
| 2005/0207801 | A1 | 9/2005 | Kunii et al. |
| 2005/0238373 | A1* | 10/2005 | Takayanagi |
| 2005/0286920 | A1 | 12/2005 | Baba et al. |
| 2006/0008302 | A1 | 1/2006 | Someya et al. |
| 2006/0013624 | A1 | 1/2006 | Kurotaka et al. |
| 2006/0019082 | A1 | 1/2006 | Kikuchi et al. |
| 2006/0024072 | A1* | 2/2006 | Kuroki et al. |
| 2006/0120776 | A1 | 6/2006 | Takashi et al. |
| 2006/0140689 | A1 | 6/2006 | Echigo et al. |
| 2007/0065188 | A1 | 3/2007 | Takagaki et al. |
| 2007/0071511 | A1 | 3/2007 | Suzuki et al. |
| 2007/0212126 | A1 | 9/2007 | Seto et al. |
| 2007/0212129 | A1 | 9/2007 | Takemoto et al. |
| 2007/0218386 | A1 | 9/2007 | Suzuki et al. |
| 2008/0008505 | A1 | 1/2008 | Seto et al. |
| 2008/0069606 | A1 | 3/2008 | Yamashita et al. |
| 2008/0069610 | A1 | 3/2008 | Nakajuji et al. |
| 2008/0138124 | A1 | 6/2008 | Kikuchi et al. |
| 2008/0219716 | A1 | 9/2008 | Takashi et al. |
| 2008/0219717 | A1 | 9/2008 | Kayahara et al. |
| 2008/0219718 | A1 | 9/2008 | Fujita et al. |
| 2008/0292347 | A1 | 11/2008 | Koide et al. |
| 2009/0003898 | A1 | 1/2009 | Kayahara et al. |
| 2009/0016786 | A1 | 1/2009 | Suzuki et al. |
| 2009/0074431 | A1 | 3/2009 | Aoki et al. |
| 2009/0116880 | A1 | 5/2009 | Takagaki et al. |

FOREIGN PATENT DOCUMENTS

| | | | |
|---|---|---|---|
| JP | 3042414 | | 3/2000 |
| JP | 2004-145260 | | 5/2004 |
| JP | 2005242085 | A * | 9/2005 |
| JP | 2009-003380 | | 1/2009 |
| JP | 2005-037879 | | 2/2009 |

OTHER PUBLICATIONS

Japanese Office Action mailed Nov. 27, 2012.

* cited by examiner

TRANSFER AND FIXING DEVICE USING RADIANT HEATING AND IMAGE FORMING APPARATUS USING SAME

BACKGROUND OF THE INVENTION

1. Field of the Invention

The present invention relates to a transfer and fixing device used in electronic photography, electrostatic recording, and electrostatic printing, and to an image forming apparatus comprising such a transfer and fixing device.

2. Description of the Related Art

Commonly known for many years are image forming apparatuses configured such that an image is formed on an image carrier (photosensitive member) using a developing device, that image is transferred to an intermediate transfer member using a primary transfer device, the image on the intermediate transfer member is further transferred to a transfer material using a secondary transfer device, and the image on the applicable transfer material is fixed using a fixing device.

In addition, image forming apparatuses configured to conduct the above processing steps in a sequential manner have been in general use, and there have also been proposals for image forming apparatuses comprising a so-called transfer and fixing device that can conduct the transfer processing step and the fixing processing step simultaneously, such as Japanese Patent Application Publication No. H10-63121 (called Prior Art 1 hereinafter) and Japanese Patent Application Publication No. 2004-145260 (called Prior Art 2 hereinafter).

Indicated in the aforementioned Prior Art 1 is an image forming apparatus configured to conduct secondary transfer and fixing from the intermediate transfer member onto transfer material, and indicated in the aforementioned Prior Art 2 is an image forming apparatus configured to conduct tertiary transfer and fixing from the intermediate transfer member onto transfer material after secondary transfer and fixing onto a transfer and fixing member from the intermediate transfer member.

Toner (electrically charged powder with a main component of resin) is generally used in image forming technology. The transfer processing step in this image formation is a step that is prone to invite a drop in image quality.

Paper is mainly used as the recording medium on which the image is formed, but the thickness may vary from ordinary paper to thick paper. Moreover, there is also a variety of surface characteristics from high quality to coarse. In particularly, when utilizing coarse surface paper, micro-gaps may be formed in which the surface of the paper cannot be followed, leading to the disadvantage that these micro-gap parts generate abnormal electrical discharge causing the image to become thin overall without transferring normally.

In contrast to this, in image forming apparatuses comprising a transfer and fixing function that simultaneously conducts the transfer and fixing processing steps have the advantage that this drop in image quality is not likely to occur even when using coarse surface recording medium (paper). This is because simultaneously applying pressure and heat in the transfer processing step softens and fuses the toner to become a viscoelastic block-shaped agglomerate, and transfer can be conducted in positions equivalent to the micro-gaps parts of the surface of the paper.

Because of the foregoing, it may be said that an image forming apparatus provided with a transfer and fixing device is the optimum for achieving high image quality.

Further, with a transfer and fixing device, there is no traveling with powder riding on the recording medium, and therefore there is the advantage that a transport guide can be set up with a configuration that does not narrowly limit the paper passage direction until immediately in front of the transfer and fixing unit, which has the advantage of being able to transport thick to thin paper or other paper types corresponding to a variety of conditions. There is a high degree of freedom in handling paper types in this way, which can effectively reduce the percentage of paper jams generated.

In common electronic photography, because powder rides on the recording medium to just in front of the transfer and fixing unit, and because the transport guide can only guide by setting up a gap such that this powder is not rubbed off, the recording medium becomes unstable within this gap, and many paper jams are generated.

In this regard, in order to sufficiently heighten the heat efficiency in the transfer and fixing processing step, it is necessary to heighten the temperature on the surface that fuses the recording medium (paper) and the toner, specifically, the interface between paper and toner. In the past, a system was used in which thoroughly heated and softened toner was pressurized onto the paper. Nonetheless, because not only the toner, but also the transfer and fixing member was heated in order to obtain sufficient effect in this system, if, for example, thick transfer and fixing material of 300 μm is used, and specifically if a four-drum tandem imaging system or the like is adopted and the perimeter is long, then it may not be possible to guarantee sufficient thermal efficiency. Further, cooling must be included in the latter processing step, resulting in a configuration that must both heat and cool the same member, and therefore this is an extremely disadvantageous configuration from the perspective of energy efficiency.

Technologies, for example, Japanese Patent Application Publication No. 2005-37879, have been proposed that focus on the aforementioned problem and selectively heat the recording medium (paper) itself immediately prior to contact with the toner.

Nonetheless, in this system there is still the problem of producing temperature fluctuations, specifically, there is the defect that so-called scumming is prone to occur when printing multiple pages. Moreover, because heating to the rear surface, as is conducted in conventional transfer and fixing, does not contribute to the fixing of the recording medium and wastes energy, it is preferable to increase the temperature of only the transfer surface of the recording medium prior to transfer, and to be able to prevent a temperature drop, but this kind of technology has not yet been proposed.

Means that provide a plate-shaped heating member or a high temperature rotational member and heat the recording medium to be transported (may be called "paper" hereinafter) has been considered as a method to increase the temperature of just the transfer surface of the recording medium immediately prior to transfer. Nonetheless, in either system there is the problem that the paper is separated from contact with the heating member and the paper surface temperature decreases in the interval up to arriving at the nip where the toner image is transferred, and specifically, there is the problem that the temperature drop becomes marked if the paper is thick.

Technologies relating to the present invention are also disclosed in, e.g., Japanese Patent No. 3042414 and US 2008/0199229.

SUMMARY OF THE INVENTION

It is an object of the present invention to provide a transfer and fixing device as means to heat the recording medium prior to transferring and fixing, which addresses the problems with the prior art described above, has no risk of fire, is superior in energy efficiency, and can stably heat irrespective of the thickness of the recording medium; and it is an object to provide an image forming apparatus comprising the related transfer and fixing device.

In an aspect of the present invention, a transfer and fixing device comprises a transfer and fixing member by which an image is transferred; a pressurizing member that forms a nip by pressure contact with the transfer and fixing member, and pressurizes and fixes the image on a recording medium that passes through the nip; a radiant heat source that is arranged on an upstream side of the nip in a direction of transport of the recording medium; and a thermoconductive member that is heated by the radiant heat source and heats the recording medium when in contact. A radiant heat region is provided, between the nip and the thermoconductive member, where the recording medium is heated by radiant heat from the radiant heat source.

In another aspect of the present invention, an image forming apparatus forms a color image using a multiple color toner laminating system. The apparatus comprises a transfer and fixing device formed by a transfer and fixing member by which an image is transferred and a pressurizing member that makes pressure contact with the transfer and fixing member and forms a nip; and a photosensitive member that is arranged on an upstream side of the nip unit of the transfer and fixing member and supports the image to be transferred to the transfer and fixing member. The transfer and fixing device further comprises a radiant heat source arranged on an upstream side of the nip in the direction of transport of the recording medium, and a thermoconductive member that is heated by the radiant heat source and heats the recording medium when in contact. A radiant heating region by which the idrecording medium is heated by radiant heat from the radiant heat source is provided between the nip and said thermoconductive member.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT(s)

Prior to describing various embodiment of the present invention, the prior art and its various problems will be described.

Figure 1:
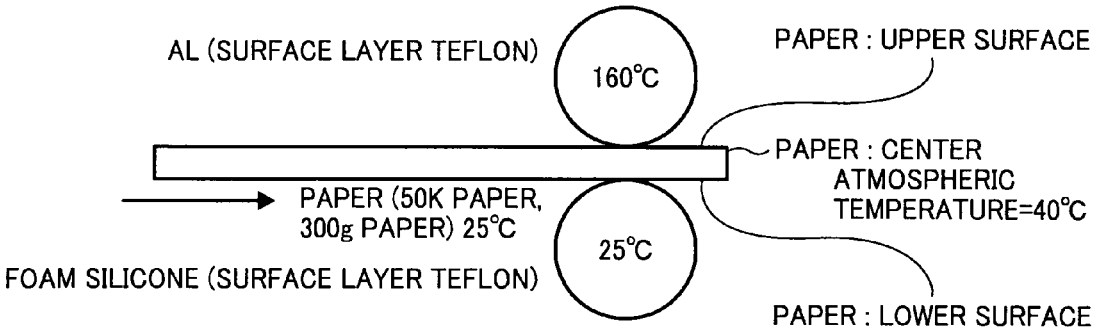
FIGS. 1 and 2 are schematic diagrams indicating the configuration and conditions used in a one-dimensional heat transfer analysis simulation using the implicit method.
Figure 2:
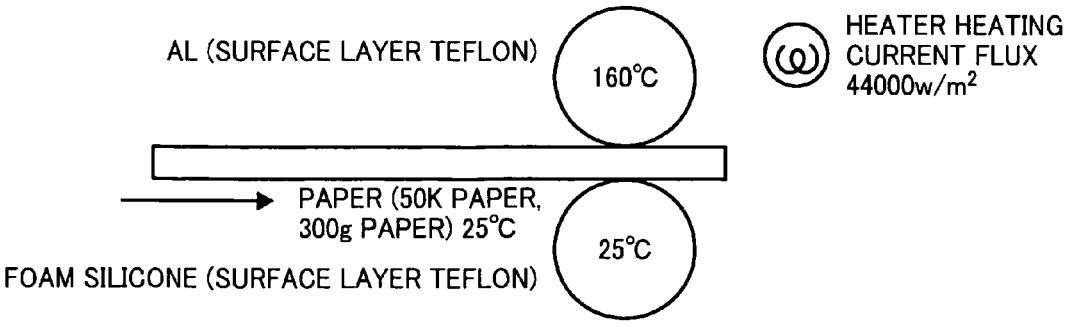

First, one example illustrating the results of a one-dimensional heat transfer analysis simulation using the implicit method will be explained. Indicated respectively in FIGS. 3 and 4 are the conditions of paper surface temperature increase when passing paper at 20 msec through the nip width between a high temperature aluminum roller at 160° C. and a foam silicone roller (Teflon (registered trademark) on both surface layers) at 25° C. as indicated in FIGS. 1 and 2.

Figure 3:
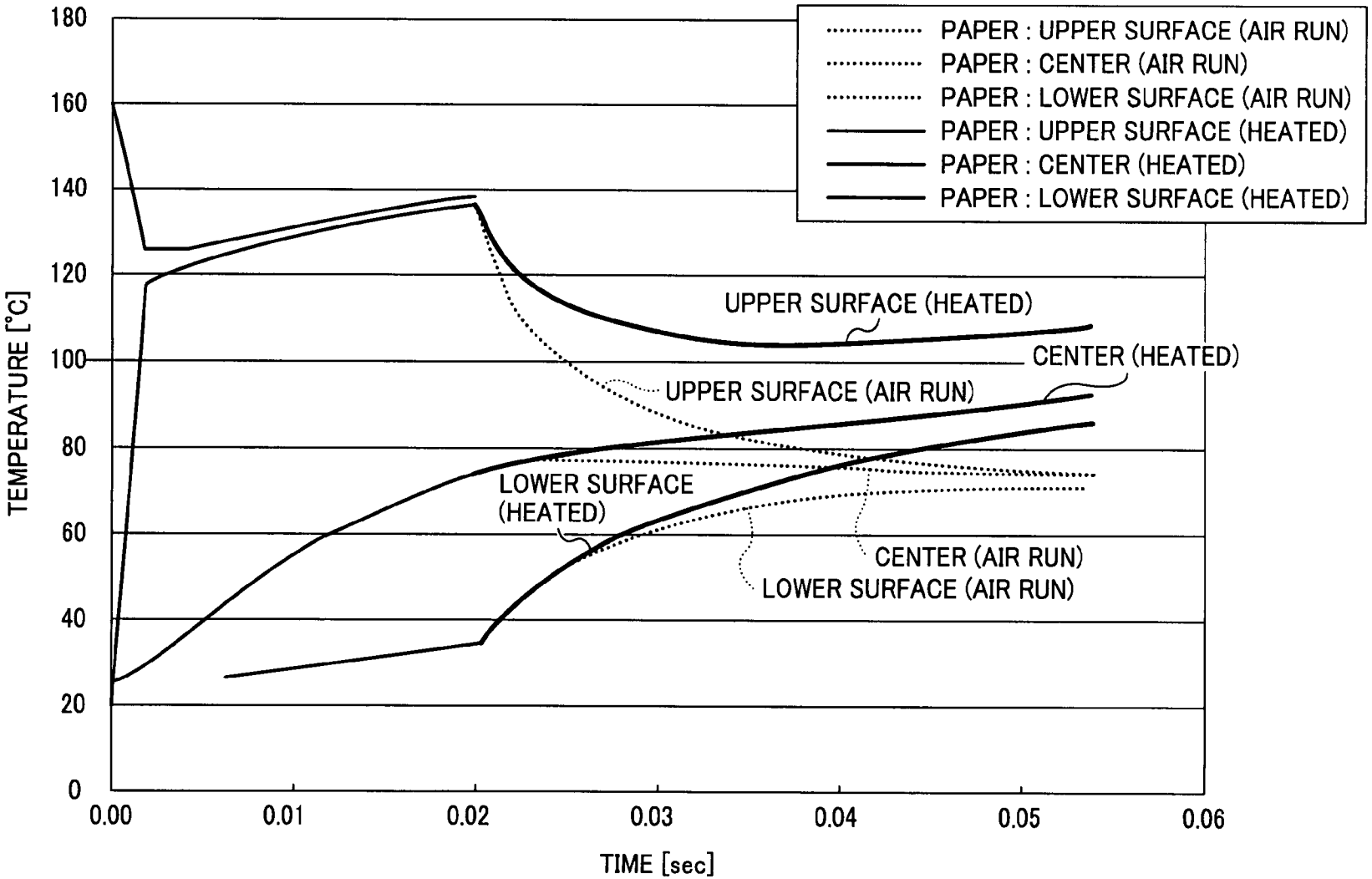
FIG. 3 is a graph indicating the results of one-dimensional heat transfer analysis simulation using the implicit method when running through thin paper (50 k paper)
Figure 4:
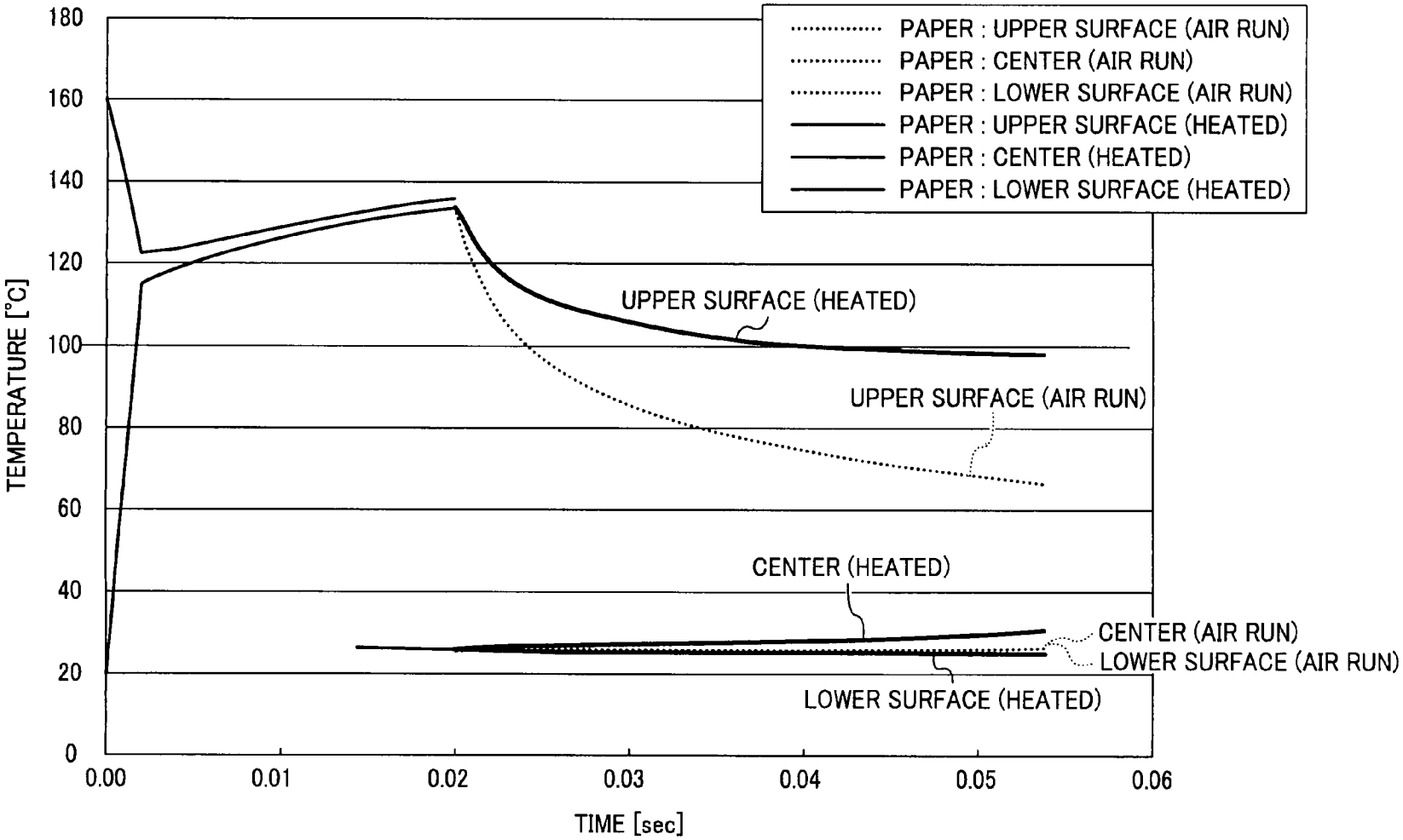
FIG. 4 is a graph indicating the results of one-dimensional heat transfer analysis simulation using the implicit method when running through thick paper (300 g paper)

The graph indicated in FIG. 3 is when thin paper (50 k paper) is passed through, and the graph indicated in FIG. 4 is when thick paper (300 g) is passed through. In the respective graphs, the "air run" is when transported with air of an ambient temperature of 40° C. as indicated in FIG. 1, and "heated" is when transported below a radiant halogen heater at a heat flux of 44000 W/m$^2$ as indicated in FIG. 2.

The temperature required when heating and fusing the toner in transfer and fixing is indicated by the paper surface temperature ("Paper: upper surface" in FIGS. 3 and 4). It is known that, if transported in 40° C. ambient air temperature, paper surface heated to approximately 140° C. in the interval of nip width 20 msec will decrease in temperature to approximately 70° C. in a transport time of about 30 msec. If using thick 300 g paper, the heat on the upper surface is thermally conducted toward the center of the low temperature paper, and therefore there is a larger temperature drop than with thin 50 k paper. In either case, the aforementioned 30 msec is when the transport distance is merely 6 mm at a transport velocity in the mid-speed region of 200 mm/sec, and it is known that there will be a notable drop in thermal efficiency unless the distance from the paper exiting the heating unit up to reaching the transfer and fixing region is shortened as much as possible.

Meanwhile, it is known that if radiant heater is used to heat the paper after exiting the heating unit, the paper surface temperature drop can be suppressed to about 30 to 40° C., and a sufficient paper surface temperature can be ensured in the transfer and fixing region even if there is a long distance from the heating unit until arriving in the transfer and fixing region.

It is possible to heat the recording medium with a heater in this way, but because the recording medium is usually white, the heat absorption rate is low, which makes efficient heating difficult and leads to the problem that sufficient heating is impossible unless the heater power (thermal strength) is larger than necessary. Further, when using this kind of strong heater, there is the possibility of more easily igniting with the heated recording medium that has jammed and stalled, and thus there are serious issues not only with energy efficiency, but also in terms of safety.

Specific embodiments of the present invention will be explained below, but the present invention is not limited to the following embodiments.

Embodiment 1

Figure 5:
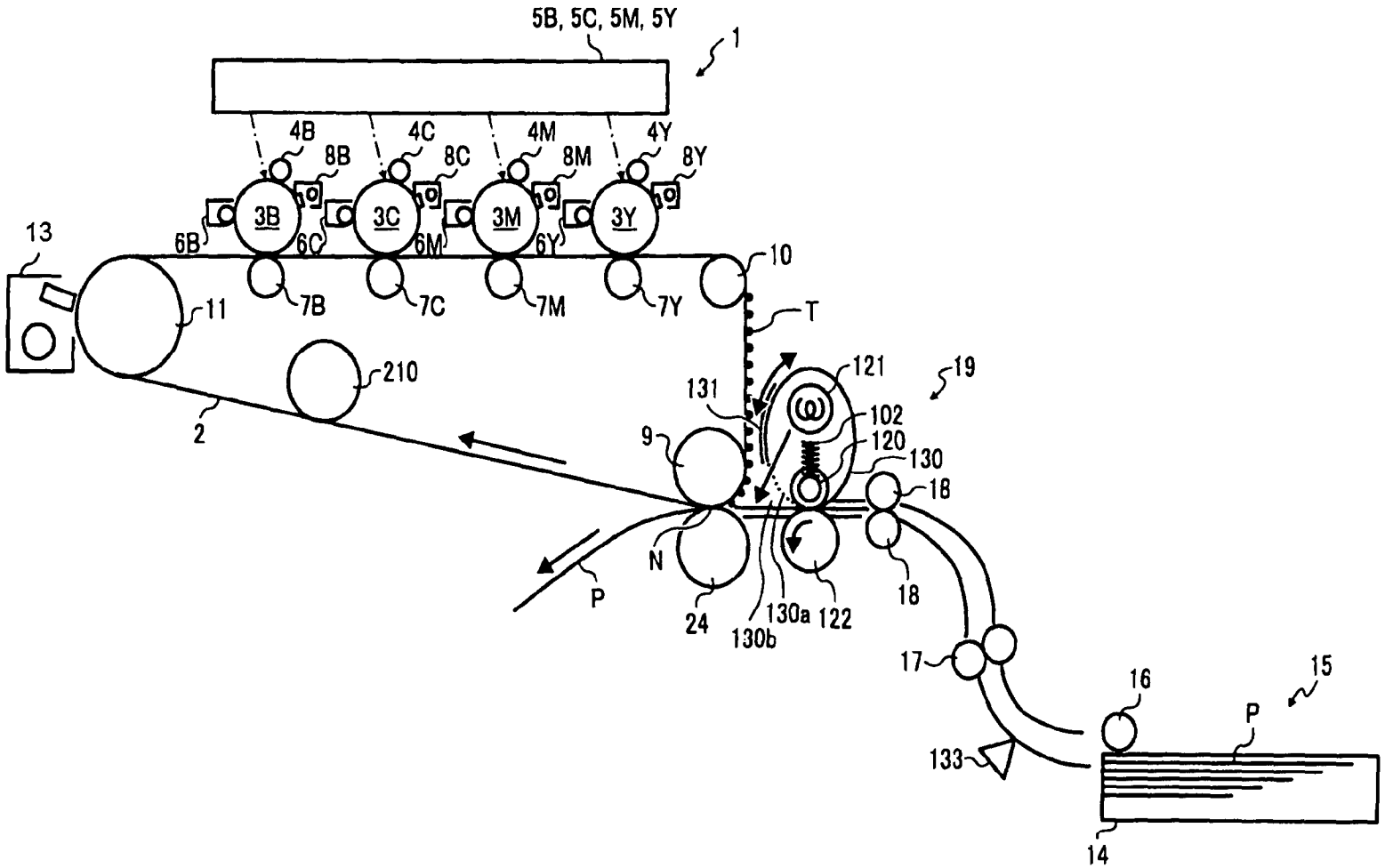
FIG. 5 is a schematic diagram indicating the configuration of a first embodiment of an image forming apparatus related to the present invention.

Indicated in FIG. 5 is a schematic diagram of a tandem color copier as embodiment 1 of an image forming apparatus related to the present invention.

The color copier 1 has an image forming unit 19 that is positioned in the center of the main unit, a paper feed unit 15 that is positioned below the image forming unit 19, and an image reading unit positioned above the image forming unit 19. The image forming device of this embodiment 1 can form images at a linear velocity of 200 mm/s. Arranged in the image forming unit 19 is a transfer and fixing belt 2 as a transfer and fixing member having a transfer surface extending horizontally. A configuration for forming images of color separation colors and complementary color related colors is set up on the upper surface of the transfer and fixing belt 2. Specifically, photosensitive members 3Y, 3M, 3C, and 3B, which are image carriers that can carry images based on toner of complementary color related colors (yellow, magenta, cyan and black) are lined up in parallel on the transfer surface of the transfer and fixing belt 2.

The transfer and fixing belt 2 has a multilayer structure, specifically, a belt having a polyimide resin substrate (film thickness 40 μm), rubber (film thickness 60 μm), and a fluororesin (film thickness 6 μm) may be cited as a satisfactory example. If the recording medium for image formation has a rough surface, the aforementioned rubber layer is necessary for allowing reliable following, and the fluororesin layer on the surface contributes to toner and paper powder release characteristics.

Photosensitive members 3Y, 3M, 3C and 3B have same direction rotatable drum structures respectively. Arranged respectively around the aforementioned photosensitive members are charge devices 4Y, 4M, 4C, and 4B, which execute image formation processing in the process of rotating, write devices 5Y, 5M, 5C, and 5B, which are optical writing means, developing devices 6Y, 6M, 6C, and 6B, which house the different colors of toner, primary transfer devices 7Y, 7M, 7C, and 7B, and cleaning devices 8Y, 8M, 8C, and 8B.

The coding letters correspond to the same toner colors as in the photosensitive member 3.

The transfer and fixing belt 2 is hung around a drive roller 11 and following rollers 9 and 10, and is configured to be able to move in the same direction to positions facing opposite the photosensitive members 3Y, 3M, 3C and 3B. A cleaning device 13 that cleans the surface of the transfer and fixing belt 2 is provided in a position opposite the drive roller 11.

Next, the photosensitive members will be explained specifically regarding the actual image forming process.

First, the surface of the photosensitive member 3Y is provisionally charged by the charge device 4Y and an electrostatic latent image is formed on the photosensitive member 3Y based on image data from the image reading unit. The developing device 6Y that houses yellow toner develops this electrostatic latent image into a visible toner image, and the primary transfer of this toner image onto the transfer and fixing belt 2 is conducted by the primary transfer device 7Y that applies a specified bias.

The other photosensitive members 3M, 3C, and 3B form images in the same way, and the toner images of the respective colors are transferred and laminated in turn onto the transfer and fixing belt 2.

After conducting image transfer, the toner that remains on the various photosensitive members 3 is removed by the respective cleaning devices 8. Afterwards, the electric potentials of the various photosensitive members 3 are initialized by a neutralization lamp (not indicated in the diagram) in preparation for the next imaging forming process.

A pressurizing member (hereinafter also called "pressurizing roller") 24 is provided in a position opposite the following roller 9. The pressurizing roller 24 has the function of forming a nip N (hereinafter also called "nip" or "transfer nip") with the transfer and fixing belt 2. This pressurizing roller 24 has a pipe-shaped structure made of a metal such as, for example, aluminum, and the surface is coated with a releasing layer.

Provided on the upstream side of the nip N in the direction of paper transport are a radiant heat source (hereinafter also called "heater") 121, and a thermoconductive member 120, which is heated by the radiant heat source 121 and heats the surface of the recording medium P by contact.

The thermoconductive member 120 includes a heat lamp and is composed of a material such as copper that has high thermal conductivity, and the contact surface with the recording medium P may be formed by a layer several microns thick of low friction material such as fluororesin in order to allow sliding. In the example in FIG. 1, the heating roller 120 is provided as the thermoconductive member. The diameter of the heating roller 120 may be suitably selected corresponding to the apparatus, but 20 to 30 mm is preferable because the thermal efficiency is increased by decreasing the thermal volume of the heating roller 120.

Figure 6:
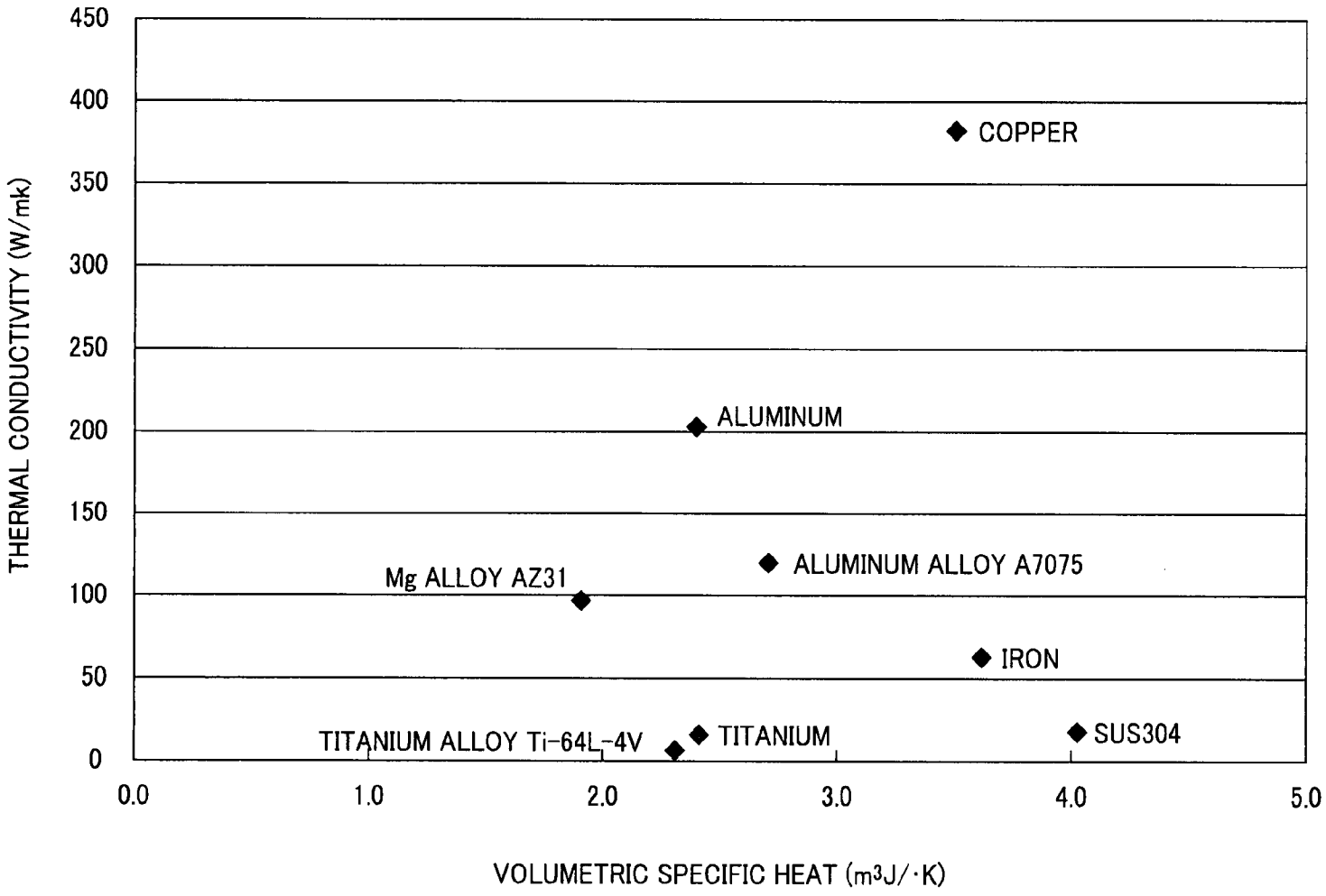
FIG. 6 is a graph indicating the coefficient of thermal conductivity and volumetric specific heat of metal materials.

Further, as indicated in FIG. 6, since copper is by far superior in thermal conductivity and volumetric specific heat, and SUS304 is by far superior in volumetric specific heat, these materials are suitable for the thermoconductive member. In addition, a color close to black is preferable as the color of the thermoconductive member. Preferably the thermal source side of the surface layer of the heating roller 120 is composed of a material with an emissivity ratio of 0.2 or more. Specifically, if the surface layer is a metal material, painting or surface processing to a black or near black color can improve the emissivity ratio. The thermal absorbance of the thermoconductive member can be improved thereby, allowing efficient heating; the start up time can be shortened, and the linear velocity when continuously passing paper through can be improved. Further, configuring with a material having high thermal volume provides stable temperature control.

The radiant heat source 121 has no particular restrictions as long as it is a heat source that can heat radiantly, but, for example, using a carbon lamp or a carbon nano-lamp, etc. allows efficient radiation of the paper at a wavelength (2.5 to 3 μm) with a high thermal absorbance ratio, thus increasing the energy efficiency. The radiant heat source 121 is covered with reflective plate 130, and therefore the heating roller 120, which is at least partially coated by the same reflective plate, efficiently receives radiant heat. While being maintained at a high temperature by heat conductance across the full length, the radiantly heated heating roller 120 is rotationally driven by a drive source not indicated in the diagram at roughly the same velocity and same direction as the paper transport velocity, which is based on the opposing roller 122. The temperature of the heating roller 120 is controlled to about 140 to 200° C. so as to heat the surface of the recording medium P.

Further, when securing a thermocouple with a diameter of 20 μm to the back surface of the paper and taking measurements in the processing step to heat the recording medium (paper) P, it was confirmed that the change in temperature of the back surface of the paper was within 5° C. from 0 to 20 ms after contacting the heating roller 120. In addition, commonly used copy paper (copy paper 6200 manufactured by Ricoh) was used for the paper.

The surface of the recording medium P is heated by pressurizing the heating roller 120 in the direction of the recording medium P using two compression springs (springs) 102 on the ends ensure making reliable contact for a fixed time (for example, for about 20 msec) with the recording medium P, which is positioned in between the heating roller and the opposing roller 122.

The surface temperature of the recording medium P drops the moment when exiting from being tightly held between the heating roller 120 and the opposing roller 122, but the temperature drop is suppressed by the surface being heated in the radiant heat region 130*b* by radiant heat leaking from and being irradiated from the opening part 130*a* of a compartment formed by reflective plate 130.

The opening 130*a* is provided with a covering mechanism that can be selectively opened and closed, and is controlled, for example, by opening if the thickness of the recording medium is 100 μm or more, and closing when the transport drive is stopped. Specifically, a shutter 131 that occludes and exposes the opening by selectively opening and closing is provided in front of or behind the opening 130*a*. The shutter may be configured to be opened and closed by a drive device (not indicated in the diagram) such as a solenoid.

For example, a sensor 133 provided upstream in the direction of paper transport detects the thickness of the paper being transported, and the drive is controlled such that, if the thickness is 100 μm or more, the shutter 131 is opened prior to the arrival of the paper at the pressure roller 122 and the opening 130*a* is exposed, if 100 μm or less, the shutter 131 is closed prior to the arrival of the paper at the pressure roller 122. Temperature increases can be controlled thereby enabling prevention of unnecessary heating of thin paper compared to thick paper, and transportation with excellent energy efficiency is possible without unnecessary heat escaping to the outside. Operation of the shutter 131 can be executed such that not only can the opening be fully opened and closed, but can also, for example, be just half closed. The extra radiant heat can thereby be adjusted.

Moreover, an equivalent effect can be manifested by the operator entering the paper type from an input device.

The sensor 133 that detects the paper thickness is arranged on the paper transport route, and calculated the thickness of the paper from load fluctuations based on contact with the paper. Further, the paper thickness may also be detected by paper size input means or transfer paper count input means provided on the operating panel.

Further, if paper transport cannot be detected because of a paper jam, etc. the drive is controlled to close the shutter 131. When the paper is jammed, even if, for example, the heater 121 and the paper P are not making direct contact, there is the risk of fire by igniting the paper because of standing still for a long time. However, ignition can be prevented by occluding the opening.

Ignition by the paper P entering from the opening and coming into contact with the heater 121 can be prevented by configuring the opening 130*a* with, for example, with a net or lattice shaped member. The heated paper P is transported into the nip N formed between the following roller 9 and the pressurizing roller 24, and the toner T that has been heat fused here by the transfer and fixing belt 2 is simultaneously transferred onto the paper surface and fixed.

In this configuration, because the toner T riding on the transfer and fixing belt 2 can be arranged in close proximity to the opening 130*a*, the toner prior to transfer is radiantly heated, thereby improving the transfer and fixing efficiency at the nip N. Because a minimum of heating of the transfer and fixing belt 2 is conducted immediately prior to the nip N, a temperature increase of the transfer and fixing belt 2 is suppressed by the belt simply cooling during one rotation.

The paper feed unit 15 has a paper feed tray 14 for housing a stack of paper P as the recording medium, a paper feed collar 16 for separating and feeding paper P in this paper feed tray 14 one at a time in order from the top, transport roller pair 17 for transporting the paper P that has been fed, and a resist roller 18 for temporarily stopping the paper P and then sending in the direction of the nip N at a timing in which the tip of the image on the transfer and fixing belt 2 after having been corrected for slant displacement agrees with a specified position in the direction of transport.

In this regard, the toner image T (simply called the "toner" hereinafter), which has undergone primary transfer from the previously described photosensitive members 3Y, 3M, 3C and 3B onto the transfer and fixing belt 2, is transferred by electrostatic force onto the transfer and fixing belt 2 based on bias (bias applied by the following roller 11 (AC, including superimposition of pulses, etc.)) from a specified bias application means.

In the image forming apparatus indicated in FIG. 5, a leveling roller 210 for equalizing the temperature of the transfer and fixing belt 2 is provided between the transfer unit for the transfer and fixing belt 2 and the transfer unit for the furthest upstream photosensitive member 3B. The leveling roller 210 is composed from heat pipe or a material such as graphite that has high thermal conductivity, and is arranged so as to rotate when in contact with the transfer and fixing belt 2. The leveling roller 210 may be jointly used to provide a heat pipe function related to the drive roller 11.

The toner image T transferred onto the transfer and fixing belt 2 is heated by a quantity of heat from the recording medium (paper) P up to being fixed on the recording medium (paper) P by the nip N.

In conventional well-known color image forming apparatuses it was necessary to impart a quantity of heat 1.5 times that of a black and white image forming apparatus to compensate for the temperature drop caused by the recording medium (paper). For that reason there was a tendency to heat the recording medium (paper) more than necessary, and to excessively raise the adhesiveness with the toner.

In the configuration of embodiment 1, the temperature at the boundary between the toner and the recording medium can be controlled because the radiant heat source 121 and the thermoconductive member 120 heat only the surface of the recording medium immediately prior. The temperature of the transfer and fixing belt 2 (fixing set temperature) can thereby be kept lower just by taking the temperature drop of the recording medium (paper) into consideration and avoiding application of more heat than necessary, and by preventing excessive heating of the recording medium (paper) as previously described. Moreover, a temperature suitable for formation of images having full luster can be independently set.

According to the image forming apparatus of embodiment 1 the configuration can fix at comparatively low temperatures, and therefore when forming images the so-called warm up time can be shortened to provide excellent energy savings. In addition, because heat transfer to the imaging forming unit can also be avoided, deterioration of the parts by heat can be prevented and the durability of the apparatus can be improved.

As described above, the image forming apparatus of embodiment 1 is positioned as a "transfer and fixing device", as opposed to a conventional fixing device that simply heats and pressurizes paper supporting an unfixed toner image.

Embodiment 2

Next, embodiment 2 of the present invention will be explained by referring to FIG. 7.

Figure 7:
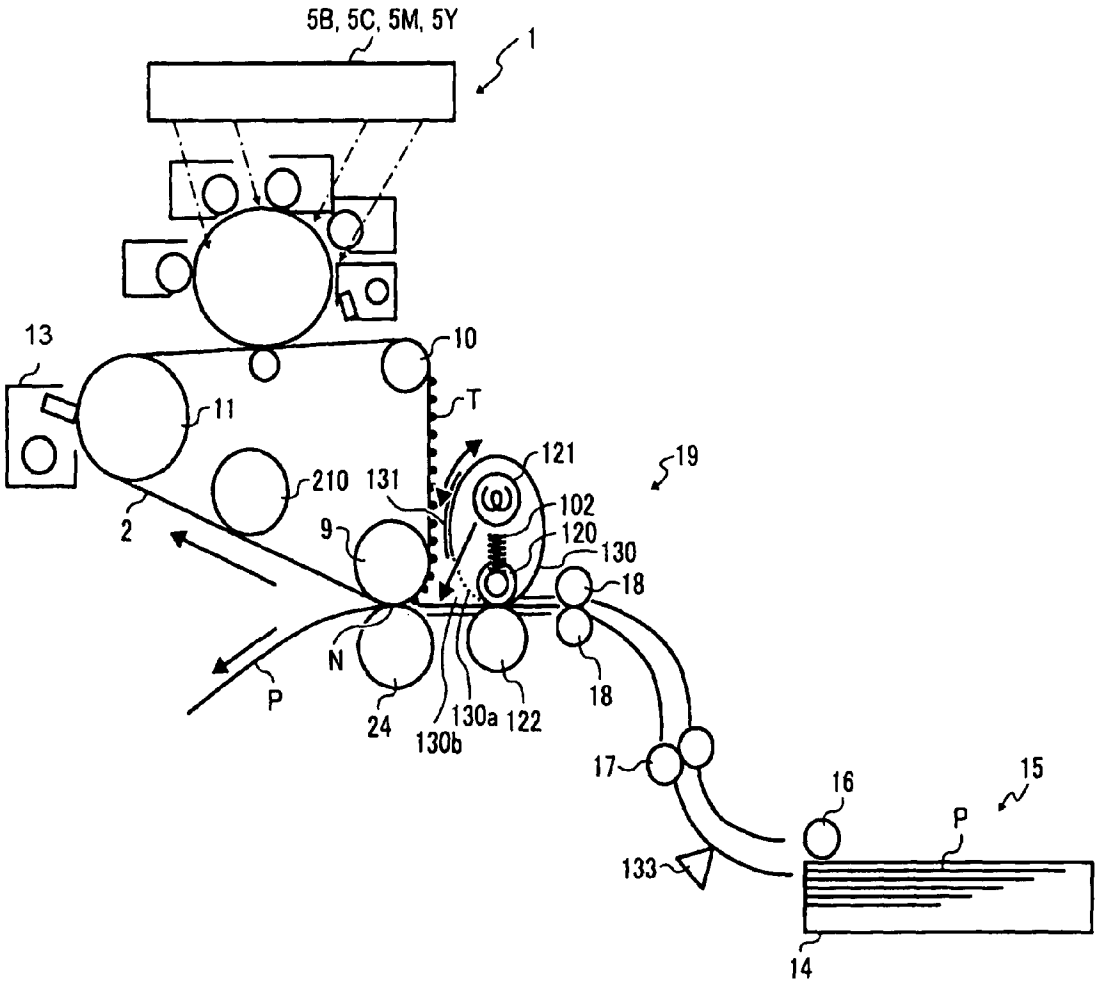
FIG. 7 is a schematic diagram indicating the configuration of an IOI-type color copier as a second embodiment of an image forming apparatus related to the present invention.

FIG. 7 is an example of an image forming apparatus that is a so-called IOI type color copier that laminates color on a single photosensitive member. Further, the same codes are applied to parts in the image forming apparatus of FIG. 7 that are the same as in the image forming apparatus of FIG. 5 described above, and redundant explanations will be omitted.

In a photosensitive member color lamination system, all the processing steps for one color of toner, including charging, exposing (reading) and developing, are conducted in a series of processing steps for all the colors of toner on a single photosensitive member.

The configuration indicated in FIG. 5, which provides photosensitive members for every color and conducts the image forming process on one photosensitive drum for each color is a four drum tandem system, but this photosensitive drum color lamination system is superior for high velocity applications compared to the four drum tandem system, and can save space and lower costs as an apparatus overall.

Embodiment 3

Next, embodiment 3 of the present invention will be explained while referring to FIG. 8.

Figure 8:
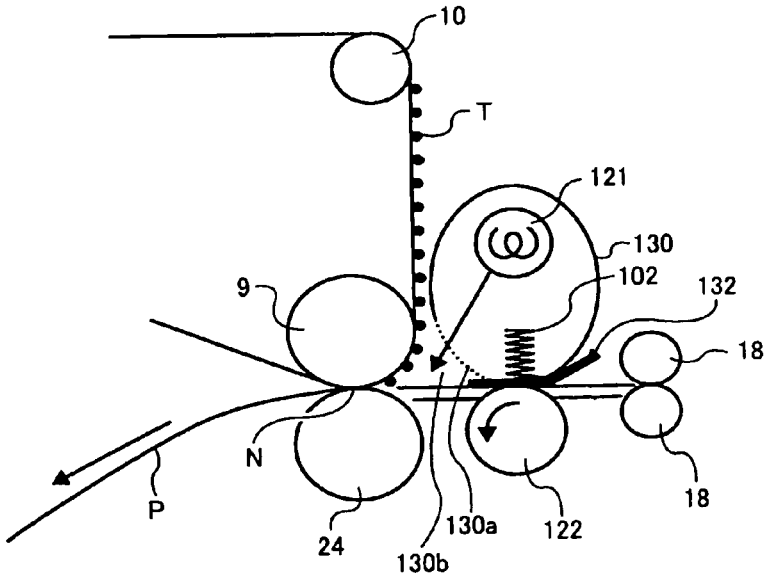
FIG. 8 is a schematic diagram indicating as a third embodiment of an image forming apparatus related to the present invention a configuration in which the heat transfer member is plate-shaped.

In the example in FIG. 8, a plate-shaped transportation guide plate 132 is provided as the thermoconductive member. The plate thickness of the guide plate 132 can be suitably selected corresponding to the device, but preferably is 1 to 2 mm to increase the heating efficiency by reducing the thermal volume of the guide plate 132.

Graphite with high thermal conductivity or copper is suitable as the material of the thermoconductive member. Preferably, the color of the thermoconductive member is a color close to black. Preferably, the surface of at least the heater 121 side (upper side) of the guide plate 132 is composed of a material with an emissivity ratio of 0.2 or more. Specifically, if the top surface is a metal material, painting or surface processing to a black or near black color can improve the emissivity ratio. The thermal absorbance of a member that thermally conducts can be improved thereby, allowing efficient heating; the start up time can be shortened, and the linear velocity when continuously passing paper through can be improved. Further, configuring with a material having high thermal volume provides stable temperature control.

The surface (lower surface) of the guide plate 132 that contacts the recording medium P may be formed by a layer several microns thick of low friction material such as fluororesin in order to allow sliding. Moreover, the guide plate 132 is heated by radiant heat from the heater 121, is maintained at a high temperature by thermal conductance across the entire length, and heats the paper P by contacting the surface of the paper being transported and conducting heat to the surface of the paper.

In the same way as the apparatus indicated in FIG. 5 as embodiment 1, an opening 130*a* is provided on the downstream side in the direction of paper transport. The surface of the paper P being transports is heated by the radiant heat from the heater 121 in the interval up to receiving paper P into the nip N. The opposing roller 122 is rotationally driven by a drive source not indicated in the diagram at roughly the same velocity as the velocity of paper transport and in the same direction. The opposing roller 122 is composed of a flexible material such as foam silicone, and when the guide plate 132 is pressurized by the springs 102 the nip width during transport becomes large, the contact time with the paper increases, the heating time is maintained even if, for example, the paper transport velocity is increased, and stable heating of the paper P can be achieved.

Embodiment 4

Next, embodiment 4 of the present invention will be explained by referring to FIG. 9.

Figure 9:
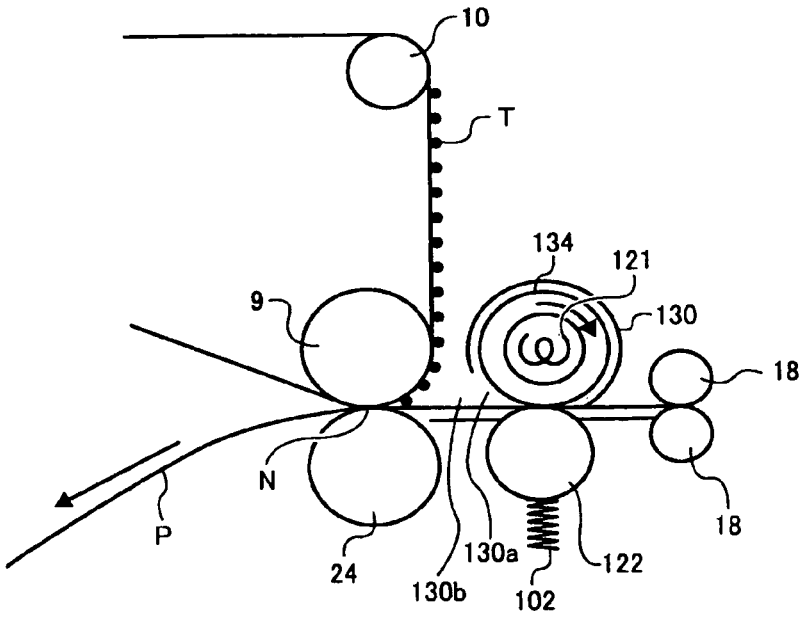
FIG. 9 is a schematic diagram indicating as a fourth embodiment of an image forming apparatus related to the present invention a configuration in which the heat source is embedded in a material through which the thermal transfer member can pass radiant heat.

FIG. 9 is an example of configuring the thermoconductive member with a transparent rotational member 134. The transparent roller 134 made of glass or the like to the inside of which the heater 121 is secured is driven rotationally by a drive device not indicated in the diagram in the direction of paper transport at roughly the same velocity. In order to improve adhesiveness with the paper P, the opposing roller 122 is pressurized from the back side by the spring 102. The radiance efficiency can be increased by arranging the reflective plate 130 nearby, and by providing an opening on the downstream side, radiant heat from the transparent roller wall can be used to heat the paper being transported up to the nip N.

Next, a specific example of spherical toner will be explained.

It is known that toner transfer characteristics (transfer efficiency, fidelity) have an affect on the quality of the target image, and these toner transfer characteristics participate in the shape of the toner. When conducting a study to optimize the shape of the toner for achieving high image quality, it was confirmed that toner having a Wardell practical sphericity $\phi$ of 0.8 or more has satisfactory transfer characteristics.

Wardell practical sphericity p is indicated by the following formula.

$\phi$=(Diameter of a circle having an area equal to a particle-projected area)/(Diameter of a circle that is circumscribed with a particle-projected image)

Specifically, this value can be easily calculated by taking a suitable amount of toner onto a glass slide, magnifying (500 times) by microscope, and measuring any optional 100 toner particles. By using toner that fulfills these conditions, the secondary transfer efficiency can be heightened and the quality can be increased.

Any of the conventional well-known materials can be used to configure the toner. Binder resins include polyesters; polymers of styrene and substitution products thereof, such as polystyrene, poly-p-chlorostyrene and polyvinyl toluene; styrene copolymers such as styrene-p-chlorostyrene copolymer, styrene-propylene copolymer, styrene-vinyl toluene copolymer, styrene-vinyl naphthaline copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-$\alpha$-methyl chlormethacrylate copolymer, styrene-acrylonitril copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-acrylonitrile-indene copolymer, styrene-maleic acid copolymer and styrene-maleic acid ester copolymer. In addition, the following mixtures of resins may be used. Specifically, for example, polymethyl methacrylate, polybutyl methacrylate, polyvinyl chloride, polyvinyl acetate, polyethylene, polypropylene, polyurethane, polyamide, epoxy resin, polyvinyl butyral, polyacrylic acid resin, rosin, modified rosin, terpene resin, phenol resin, aliphatic/alicyclic hydrocarbon resin, aromatic petroleum resin, chlorinated paraffin and paraffin wax. It is preferable to contain polyester resin for obtaining full adhesiveness. Specifically, crystalline polyester resin fully softens and melts during paper contact, and is preferable because, in addition to fixing strength, images can be formed with high color reproducibility. Polyester resins are obtained by condensation polymerization of alcohol and carboxylic acid, and usable alcohols include diols such as polyethylene glycol, diethylene glycol, triethylene glycol 1,2-propylene glycol, 1,3-propylene glycol, 1,4-butane diol, neopentyl glycol, and 1,4-butenediol; etherated bisphenol such as 1,4-bis (hydroxymethyl)cyclohexane, bisphenol A, hydrogenated bisphenol A, polyoxyethylenated bisphenol A, and polyoxypropylenated bisphenol A; dihydric alcohol monomers formed by the substitution thereof with a saturated or unsaturated hydrocarbon group having 3 to 22 carbon atoms, and other dihydric alcohol monomers. Carboxylic acids used to obtain the polyester resin include maleic acid, fumalic acid, mesaconic acid, citraconic acid, ithaconic acid, glutaconic acid, phthalic acid, isophthalic acid, terephthalic acid, cylclohexane dicarboxycylic acid, succinic acid, adipic acid, sebatic acid, malonic acid, dibasic organic acid monomers formed by the substitution thereof with a saturated or unsaturated hydrocarbon group having 3 to 22 carbon atoms, anhydrides thereof, and a dimer formed between low alkylester and linoleic acid; and other dibasic organic acid monomers.

In order to obtain polyester resins, which are the binder resins, polymers containing components based not only polymerization of just dihydric monomers or higher, but also of trihydric or higher polyfunctional monomers are preferable. Trihydric or higher alcohol monomers, which are such a polyfunctional monomer, include sorbitol, 1,2,3,6-hexane tetrol, 1,4-sorbitan, pentaerythritol, dipentaerythritol, tripentaerythritol, cane sugar, 1,2,4-butanetriole, 1,2,5-pentanetriole, glycerol, 2-methyl propanetriole, 2-methyl-1,2,4-butanetriole, trimethylolethane, trimethylolpropane, and 1,3,5-trihydroxymethylbenzene. In addition, Tribasic or higher carboxylic acid monomers include 1,2,4-benzenetricarboxylic acid, 1,2,5-benzenetricarboxylic acid, 1,2,4-cyclohexanetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylene carboxypropane, and tetra(methylenecarboxyl)methane, 1,2,7,8-octanetetracarboxylic acid, enbol timer acid and anhydrides thereof.

The toner preferably contains a releasing agent for the purpose of improving the toner release characteristics at the surface of the transfer and fixing member when transferring and fixing. Conventional and well-known releasing agents can be used, and, for example, defatted carnauba wax, montan wax, and rice wax oxide, or ester wax may be used independently or in combination.

Micro-crystalline carnauba wax with an acid number of 5 or less is satisfactory, and the particle size when dispersed in the toner binder is preferably 1 μm or less.

Montan wax commonly indicates a montan system was refined from minerals, and in the same way as the carnauba wax, micro-crystalline wax with an acid number of 5 to 14 is preferable.

Rice wax oxide is an aerial oxide of rice bran wax, and preferably has an acid number of 10 to 30.

If the acid numbers of the various waxes are less than the respective ranges, the low temperature fixing temperature rises resulting in insufficient low temperature fixation. Conversely, if exceeding the respective ranges, the cold offset temperature increases resulting in insufficient low temperature fixation.

The amount of wax added is 1 to 15 weight parts in relation to 100 weight parts of binder resin, and is preferably used in the range of 3 to 10 weight parts. If less than 1 weight part, the releasing effect is weak and the desired effect is difficult to obtain. Also, it has been confirmed that, if exceeding 15 weight parts, the spent wax causes notable problems with the carrier.

Moreover, in order to improve the fluidity of the toner, other additives such as silica, titanium oxide, alumina, as well as fatty acid metal salts, polyvinylidene fluoride, and the like may be added as necessary. Specifically, because the toner can be sufficiently heated for transfer and fixing, it is possible to formulate additives for fluidity and transferability since using a comparatively large amount of an additive such as sub-micron large particle size silica has no affect on the fixing temperature.

From the above, according to the present invention, a transfer and fixing device, as well as an image forming apparatus equipped with such transfer and fixing device, can be provided as means for heating recording medium prior to transfer and fixing, which has no risk of fire, is superior in energy efficiency, and can stably heat irrespective of the thickness of the recording medium.

The effects of the present invention are cited below.

(1) An image forming apparatus at least has a configuration, which comprises a transfer and fixing member for transferring images, and a heating member that makes pressure contact with the aforementioned transfer and fixing member and forms a nip, and which pressurizes and fixes the aforementioned image on recording medium that passes through the aforementioned nip; and further has a configuration, which comprises a radiant heat source arranged upstream from the aforementioned nip in the direction of transport of the aforementioned recording medium, and a thermoconductive member that is heated by the aforementioned radiant heat source and heats the aforementioned recording medium that is contacted, and which provides between the aforementioned nip and the aforementioned thermoconductive member a radiant heat region where the aforementioned recording medium is heated by radiant heat from the aforementioned radiant heat source; therefore a temperature drop of the surface in the interval (air running distance) up to where the recording medium (paper) arrives at the nip from the contact region with the aforementioned thermoconductive member can be suppressed by radiant heating, specifically, because the heat of the surface layer during transport is conducted in the thickness direction and the temperature drops, the temperature drop of thick paper can be prevented. Further, because the heat source of the thermal conductive member and the heat source that directly heats the paper with radiant heat can be configured by the same unit, costs can be lowered, space can be saved, and the air running distance can also be shortened.

(2) The aforementioned thermoconductive member is configured as a roller-shaped rotational member, and therefore there is little sliding friction because the high temperature roller follows around in the direction of paper transport; little paper powder is generated; the durability is superior; and the paper can be heated smoothly.

(3) The aforementioned thermoconductive member is configured as a plate-shaped member, and therefore the configuration is simple; the contact surface area with the paper can be increased by providing a long transport guide plate as the plate shaped member; and the paper can be stably heated at high speed.

(4) At least the surface of the aforementioned thermoconductive member on the heat source side is configured with a material with an emissivity ratio of 0.2 or more,and therefore the heat absorption of the aforementioned thermoconductive member is improved; the paper can be heated efficiently; the startup time can be shortened; and the linear velocity when continuously passing paper through can be increased.

(5) A covering mechanism that can selectively open and close the aforementioned opening is provided, and the aforementioned opening is exposed when the thickness of the recording medium that passes through the nip is 100 μm or more, and therefore, even if there are differences in paper thickness, a roughly identical surface temperature can be achieved in an apparatus with the same configuration. Further, when transporting thin paper with a thickness of less than 100 μm, a temperature increase higher than that of thick paper can be suppressed, unnecessary heat does not escape to the outside, and transport can be conducted with excellent energy efficiency because the aforementioned opening is not exposed.

(6) A covering mechanism that can selectively open and close the aforementioned opening is provided, and the aforementioned opening is closed when the transport drive of the aforementioned recording medium has stopped, and therefore, when there is a paper jam, although lengthy stationary times pose the risk of fire even if there is not direct contact between the heat source and the paper, this can be avoided by closing the opening.

(7) The aforementioned opening is configured with a net-shaped member or a lattice-shaped member, and therefore the paper being transported cannot enter in from the opening, and paper ignition can be prevented because there is no contact with the heat source.

(8) The aforementioned thermoconductive member is composed of a radiant heat permeable material and the aforementioned radiant heat source is enclosed within the aforementioned thermoconductive member, and therefore contact of the paper with the heat source can be prevented using a simple configuration. Further, by using a structure that exposes only part of the thermoconductive member, the same effect can be obtained as radiation from the opening when an exterior radiant heat source is provided.

(9) The aforementioned radiant heat source may have either a carbon lamp or a carbon nano-lamp, and therefore wavelengths with high thermal absorbance can be efficiently irradiated, and energy efficiency is improved.

(10) The aforementioned transfer and fixing member is arranged upstream of the nip unit, and the photosensitive member that carries the image to be transferred to the aforementioned transfer and fixing member forms a color image using a system that laminates toners of multiple colors, and therefore the apparatus can be made compact.

(11) Toner with a Wadell practical sphericity ϕ0.8 or higher is used as the developer, and therefore high image quality can be realized by using toner with improved transferability.

Various modifications will become possible for those skilled in the art after receiving the teaching of the present disclosure without departing from the scope thereof.

What is claimed is:

1. A transfer and fixing device, comprising:

a transfer and fixing member by which an image is transferred;

a pressurizing member that forms a nip by pressure contact with said transfer and fixing member, and pressurizes and fixes the image on a recording medium that passes through said nip;

a radiant heat source that is arranged on an upstream side of said nip in a direction of transport of said recording medium;

a covering mechanism that partially covers the radiant heat source, the covering mechanism having an opening therein;

a thermoconductive member that is heated by said radiant heat source and heats said recording medium when in contact; and a radiant heat region provided between said nip and said thermoconductive member, wherein said recording medium is heated by radiant heat from said radiant heat source through the opening in the covering mechanism.

2. The transfer and fixing device as claimed in claim 1, wherein said thermoconductive member is a roller-shaped rotational member.

3. The transfer and fixing device as claimed in claim 1, wherein said thermoconductive member is a plate-shaped member.

4. The transfer and fixing device as claimed in claim 1, wherein the surface on at least the heat source side of said thermoconductive member comprises a material with an emissivity ratio of 0.2 or more.

5. The transfer and fixing device as claimed in claim 1, wherein the opening of the covering mechanism can be selectively opened and closed, and wherein said opening is opened and closed corresponding to a thickness of said recording medium that passes through the nip.

6. The transfer and fixing device as claimed in claim 5, wherein the said opening is opened when the thickness of said recording medium is 100 microns or more.

7. The transfer and fixing device as claimed in claim 5, wherein the opening is formed by a net-shaped member or a lattice-shaped member.

8. The transfer and fixing device as claimed in claim 1, wherein said thermoconductive member comprises a radiant heat permeable material, and said radiant heat source is enclosed in said thermoconductive member.

9. The transfer and fixing device as claimed in claim 1, wherein said radiant heat source is either a carbon lamp or a carbon nano-lamp.

10. The transfer and fixing device as claimed in claim 1, wherein the opening of the covering mechanism is configured to be selectively opened and closed, and wherein said opening is closed when transportation drive for said recording medium has stopped.

11. The transfer and fixing device as claimed in claim 10, wherein said opening is configured with a net-shaped member or a lattice-shaped member.

12. An image forming apparatus that forms a color image using a multiple color toner laminating system, the apparatus comprising:

a transfer and fixing device formed by a transfer and fixing member by which an image is transferred and a pressurizing member that makes pressure contact with said transfer and fixing member and forms a nip; and a photosensitive member that is arranged on an upstream side of the nip of said transfer and fixing member and supports the image to be transferred to said transfer and fixing member, wherein said transfer and fixing device includes a radiant heat source arranged on an upstream side of said nip in the direction of transport of said recording medium, a covering mechanism that partially covers the radiant heat source, the covering mechanism having an opening therein, and a thermoconductive member that is heated by said radiant heat source and heats said recording medium when in contact, and wherein a radiant heating region by which said recording medium is heated by radiant heat from said radiant heat source is provided between said nip and said thermoconductive member, wherein the recording medium is heated by the radiant heat through the opening in the covering mechanism.

13. The image forming apparatus as claimed in claim 12, wherein said thermoconductive member is a roller-shaped rotational member.

14. The image forming apparatus as claimed in claim 12, wherein said thermoconductive member is a plate-shaped member.

15. The image forming apparatus as claimed in claim 12, wherein the surface on at least the heat source side of said thermoconductive member comprises a material with an emissivity ratio of 0.2 or more.

16. The image forming apparatus as claimed in claim 12, wherein the opening of the covering mechanism can be selectively opened and closed, and wherein said opening is opened and closed corresponding to a thickness of said recording medium that passes through the nip.

17. The image forming apparatus as claimed in claim 16, wherein the said opening is opened when the thickness of said recording medium is 100 microns or more.

18. The image forming apparatus as claimed in claim 16, wherein the opening comprises a net-shaped member or a lattice-shaped member.

19. The image forming apparatus as claimed in claim 12, wherein the opening of the covering mechanism is configured to be selectively opened and closed, and wherein said opening is closed when the transportation drive of said recording medium has stopped.

20. The image forming apparatus as claimed in claim 19, wherein said opening is configured with a net-shaped member or a lattice-shaped member.

* * * * *